United States Patent [19]

Katsuta

[11] Patent Number: 5,070,218

[45] Date of Patent: Dec. 3, 1991

[54] KEY GUIDE APPARATUS FOR ELECTRONIC MUSICAL INSTRUMENT

[75] Inventor: Masanori Katsuta, Iwata, Japan

[73] Assignee: Kabushiki Kaisha Kawai Gakki Seisakusho, Hamamatsu, Japan

[21] Appl. No.: 602,591

[22] Filed: Oct. 24, 1990

[30] Foreign Application Priority Data

Oct. 26, 1989 [JP] Japan ..... 124524[U]

[51] Int. Cl.[5] ..... H01H 9/26; G10C 3/12

[52] U.S. Cl. ..... 200/5 A; 84/434

[58] Field of Search ..... 200/5 R, 5 A, 6 R; 84/434, 435, 436

[56] References Cited

U.S. PATENT DOCUMENTS 4,043,244 8/1977 Schrecongost et al. ..... 84/434
4,272,657 6/1981 Iijima ..... 200/5 A
4,474,100 10/1984 Kondo ..... 84/434

FOREIGN PATENT DOCUMENTS 57-25261 6/1982 Japan .
58-7425 2/1983 Japan .
58-46462 10/1983 Japan .
58-50356 11/1983 Japan .
59-28452 8/1984 Japan .
59-184195 12/1984 Japan .

*Primary Examiner*—Harold Broome
*Attorney, Agent, or Firm*—Armstrong, Nikaido, Marmelstein, Kubovcik & Murray

[57] ABSTRACT

A key guide apparatus for an electronic musical instrument, having a plurality of keyboard switches, such as an electronic organ. Keyboard switches utilizing a movable contact are contained in a flexible member and stationary contacts are disposed on a switch base plate which is attached to a lower surface of a keyboard frame in a cantilevered manner. An integrally formed key guide having a plurality of key guide pieces and a retaining member is attached to the keyboard frame such that the retaining member is in contact with the switch base plate to prevent the base plate from deflecting, which would result in time delay after depression of the keys.

4 Claims, 2 Drawing Sheets

KEY GUIDE APPARATUS FOR ELECTRONIC MUSICAL INSTRUMENT

BACKGROUND OF THE INVENTION

This invention relates to a key guide apparatus for an electronic musical instrument such as an electronic organ.

FIG. 7 shows a conventional keyboard switch for a musical instrument. Each keyboard switch comprises a movable contact and two or more stationary contacts. The movable contact is contained in rubber member a and the stationary contacts are disposed on a switch based plate b. The rubber member a, which is supported on switch plate b, projects upward through keyboard frame c, via hole d. Switch base plate b is attached to a lower surface of keyboard frame c in a cantilevered manner. A guide bushing e is mounted on top of comb-tooth piece f, which is formed by a perpendicularly disposed portion of keyboard frame c.

In the above-described musical instrument, when key g is depressed to strike a musical note, switch base plate b is deflected as shown in broken lines of FIG. 7. After the depressing force is removed, key g is lifted by the resilient force of rubber member a. A problem exists in that the switching-on of the keyboard switches will be delayed a small amount. Another problem exist in that the insertion of guide bushing e for the respective keys is a complex and time consuming manufacturing operation. The timing problem can be solved if switch base plate b is attached to keyboard frame c at both ends instead of only at one end as shown in FIG. 7. However, then another problem arises in that the number of parts increases, therefore the complexity of the manufacturing operation is increased.

This invention solves the above-described problems.

SUMMARY OF THE INVENTION

This invention is a key guide apparatus for an electronic musical instrument having a plurality of keyboard switches, each of the keyboard switches comprising a movable contact and stationary contacts, the movable contact being contained in a flexible member and the stationary contacts being disposed on a switch base plate which is attached to a lower surface of a keyboard frame in a cantilevered manner, the key guide apparatus comprising a plurality of key guide pieces attached to the keyboard frame, and a retaining member, the retaining member being disposed in contact with an end portion of the switch base plate such that the base plate is prevented from being deflected.

The key guide can be an integrally formed unit, having the key guide pieces and retaining member thereon.

By preventing the base plate from being deflected when a key is depressed, the timing of the switching on of the keyboard switches will not be delayed.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF THE INVENTION

Figure 1:
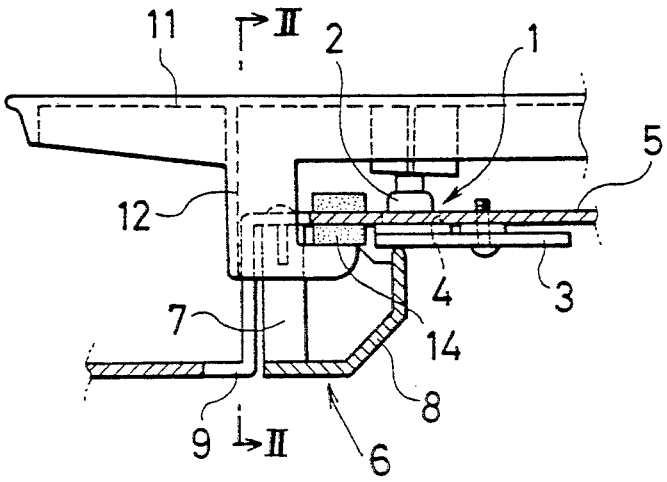
FIG. 1 is a sectional side view of one embodiment of the present invention.
Figure 2:
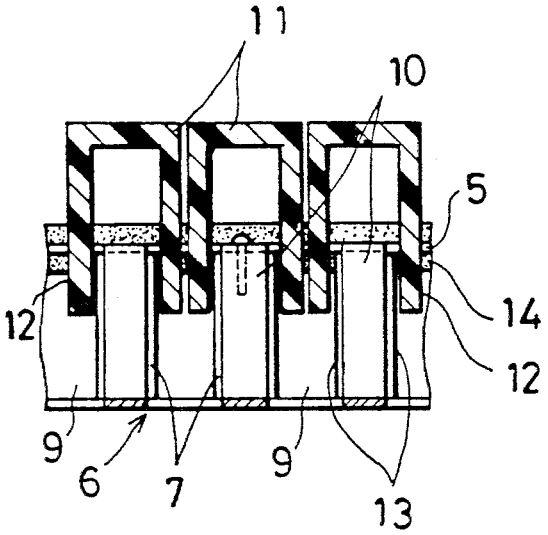
FIG. 2 is a sectional view taken along line II—II of FIG. 1.

FIG. 1 illustrates one embodiment of the invention. Keyboard switch 1 comprises a movable contact and two or more stationary contacts, the movable contact being contained in a flexible member such as cup-like rubber member 2. The stationary contacts are disposed on a switch base plate 3, which may be constructed of a single piece or multiple pieces, depending on necessity. Cup-like rubber member 2 is attached to switch base plate 3 and projects upwards through keyboard frame 5 through hole 4. Switch base plate 3 is supported at the rear portion thereof on the keyboard frame 5 in a cantilevered manner, via spacers which are formed in keyboard frame 5.

Figure 3:
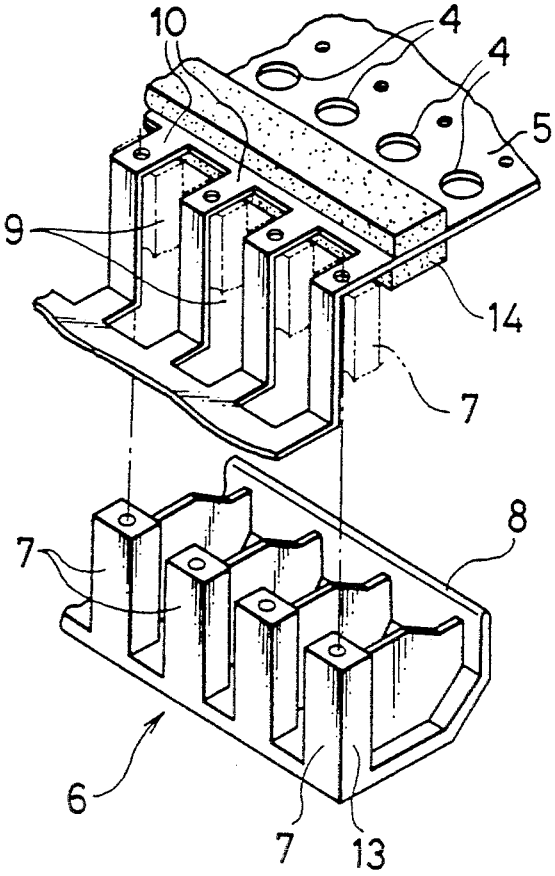
FIG. 3 is an exploded perspective view of the invention.

FIG. 3 is an exploded view of key guide 6. Key guide 6 comprises a plurality of key guide pieces 7, and an elongated plate-like retaining member 8 which is formed integrally with the key guide pieces 7 and which prevents the switch base plate 3 from deflecting, by supporting it as shown in FIG. 1. Keyboard frame 5 is formed in the shape of a step with a plurality of slits 9 formed therein, and located at the front portion of key guide 6. Key guide 6 is attached to keyboard frame 5 with fasteners at various points, such as belt-like portions 10. The upper surfaces of key guide pieces 7 are in contact with the belt-like portions 10. Assembled in this manner, retaining member 8 contacts the lower surface of the front end of switch base plate 3. Key 11 has L-shaped pieces 12 extending downwards from both side walls thereof. The L-shaped pieces 12 are inserted into slots 9 on both sides of guide piece 7. L-shaped pieces 12 are guided by guide surfaces 13 which are formed by the side surfaces of key guide piece 7 which extend outward from belt-like portion 10. A tip of L-shaped piece 12 is disposed to contact an upper limit stopper 14 which is provided on keyboard frame 5.

Figure 4:
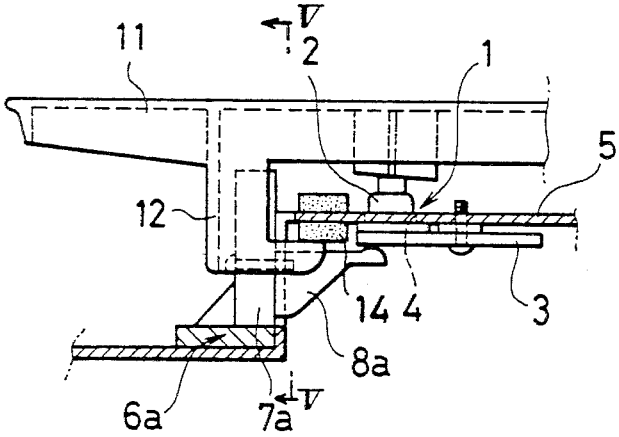
FIG. 4 is a sectional side view of a second embodiment of the invention.
Figure 5:
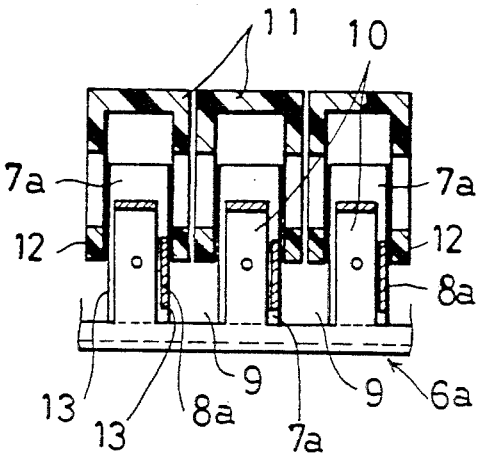
FIG. 5 is a sectional view taken along line V—V of FIG. 4.
Figure 6:
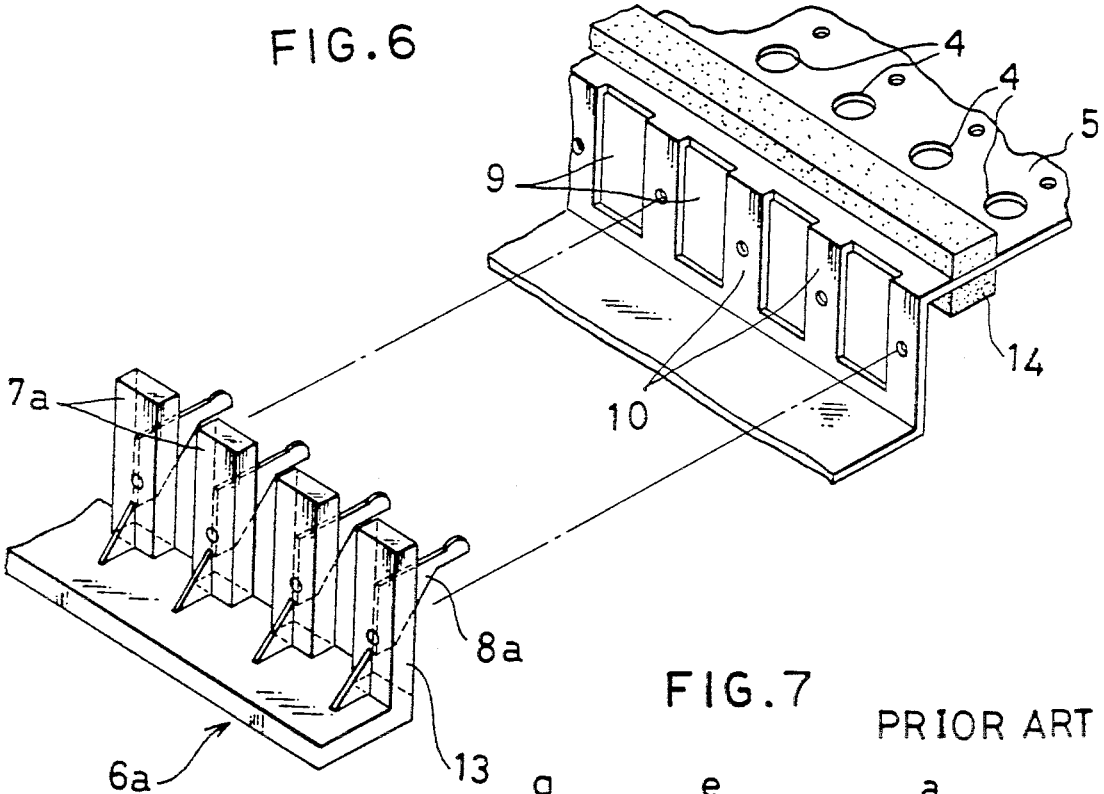
FIG. 6 is an exploded perspective view of the embodiment of FIG. 4.
Figure 7:
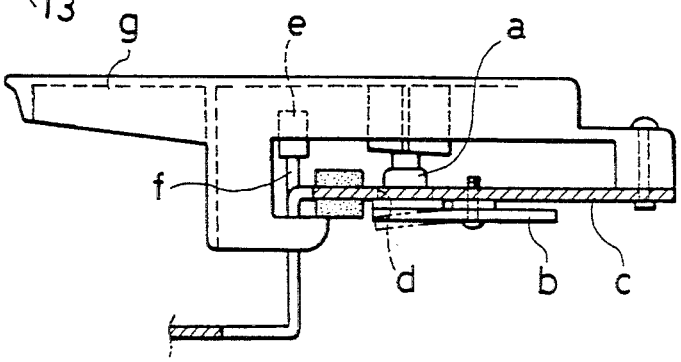
FIG. 7 PRIOR ART
FIG. 7 is an sectional side view of a conventional apparatus.

FIGS. 4, 5 and 6 show a second embodiment of the invention. According to FIG. 6, key guide 6*a* comprises a plurality of key guide pieces 7*a* and retaining member which is divided into a plurality of substantially triangular retaining pieces 8*a*. Retaining pieces 8*a* are formed to extend from one side of the rear face of the key guide piece 7*a*. The key guide 6*a* is mounted on the upper surface of keyboard frame 5, by inserting each of the retaining members 8*a* through each of the slots 9 and then fastening it to keyboard frame 5 at a suitable number of points.

The simplified constructions of the key guide apparatus significantly reduce the number of parts over the conventional methods, which therefore reduces the complexity and cost of manufacture. In addition, the time lag in switching-on of the keyboard switches as a result of key depression can be eliminated.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A keyboard for an electronic musical instrument, said keyboard comprising:

a plurality of keyboard switches, wherein each switch comprises a switch base plate having one or more stationary contacts disposed thereon, said switch base plate being attached to a lower surface of a keyboard frame in a cantilevered manner; a flexible member located between said switch base plate and a manually depressed key which acts upon the flexible member when depressed; and a movable contact contained in said flexible member which contacts one of the stationary contacts when the key is depressed; and said keyboard further comprising a key guide apparatus, wherein said key guide apparatus comprises a plurality of key guide pieces for guiding individual keys of said keyboard attached to said keyboard frame and a retaining member, said retaining member being disposed in contact with an end portion of said switch base plate.

2. A keyboard for an electronic musical instrument as recited in claim 1, wherein said key guide pieces and said retaining member are an integrally formed unit.

3. A keyboard for an electronic musical instrument as recited in claim 1, wherein said retaining member is divided into a plurality of pieces, and a piece extends from each of said key guide pieces.

4. A keyboard for an electronic musical instrument as recited in claim 2, wherein said retaining member is divided into a plurality of pieces, and each of said pieces extends from each of said key guide pieces.

* * * * *